US006642678B1

(12) United States Patent
Allen et al.

(10) Patent No.: US 6,642,678 B1
(45) Date of Patent: Nov. 4, 2003

(54) LINEAR ACCELERATOR

(75) Inventors: John Allen, Haywards Heath (GB); Leonard Knowles Brundle, Haywards Heath (GB); Terry Arthur Large, Lindfield (GB); Terence Bates, Horsham (GB)

(73) Assignee: Elekta AB, Stockholm (SE)

( * ) Notice: Subject to any disclaimer, the term of this patent is extended or adjusted under 35 U.S.C. 154(b) by 0 days.

(21) Appl. No.: 10/049,426

(22) PCT Filed: Aug. 3, 2000

(86) PCT No.: PCT/GB00/03024

§ 371 (c)(1),
(2), (4) Date: Feb. 5, 2002

(87) PCT Pub. No.: WO01/11929

PCT Pub. Date: Feb. 15, 2001

(30) Foreign Application Priority Data

Aug. 6, 1999 (GB) ..... 9918455

(51) Int. Cl.[7] ..... H05H 9/00
(52) U.S. Cl. ..... 315/505
(58) Field of Search ..... 315/5.42, 5.46, 315/505, 111.61

(56) References Cited

U.S. PATENT DOCUMENTS

| | | | | |
|---|---|---|---|---|
| 4,024,426 A | | 5/1977 | Vafuine | 315/5.41 |
| 4,382,208 A | * | 5/1983 | Meddaugh et al. | 315/5.41 |
| 4,400,650 A | * | 8/1983 | Giebeler, Jr. | 315/5.41 |
| 4,651,057 A | * | 3/1987 | Uetomi et al. | 315/5.41 |
| 5,381,072 A | * | 1/1995 | Tanabe | 315/5.41 |
| 5,734,168 A | * | 3/1998 | Yao | 250/492.3 |
| 6,369,585 B2 | * | 4/2002 | Yao | 324/636 |
| 6,376,990 B1 | * | 4/2002 | Allen et al. | 315/5.41 |

FOREIGN PATENT DOCUMENTS

GB 2 234 139 8/1999

OTHER PUBLICATIONS

Tanabe E. et al: "Compact multi–energy electron linear accelerators" Nuclear Instruments & Methods in Physics Research, Section—B: Beam Interactions with Materials and Atoms, NL, North–Holland Publishing Company. Amsterdam, vol. B10/11, No. Part 02, 1985, pp. 871–876, p. 873, right–hand column, paragraph 2.

* cited by examiner

*Primary Examiner*—Don Wong
*Assistant Examiner*—Minh D A
(74) *Attorney, Agent, or Firm*—Kinney & Lange, P.A.

(57) ABSTRACT

A standing wave linear accelerator has a plurality of resonant cavities located along a particle beam axis. One or more pairs of resonant cavities are electromagnetically coupled via a coupling cavity. A rotationally asymmetric element within the coupling cavity is adapted to rotate about an axis that is substantially parallel to the axis of the coupling cavity. The coupling cavity is imperfectly symmetric about its axis due to a relative excess of material disposed within the cavity in the portion opposed to the apertures. Rotation of the polarization of a $TE_{111}$ mode inside the cylindrical cavity provided a simple single mechanical control of coupling value, that has negligible effect on the phase shift across the device. A slight frequency dependence on the angle of rotation is correctable by a relative excess of material located opposite the apertures between the coupling cavity and the accelerating cavities.

22 Claims, 12 Drawing Sheets

LINEAR ACCELERATOR

TECHNICAL FIELD OF THE INVENTION

The present invention relates to a linear accelerator.

BACKGROUND ART

Linear accelerators, particularly of the standing wave design, are known as a source of an energetic electron beam. A common use is the medical treatment of cancers, lesions etc. In such applications the electron beam either emerges through a thin penetrable window and is applied directly to the patient, or is used to strike an X-ray target to produce suitable photon radiation.

It is often necessary to vary the incident energy of the electron beam fore either type of treatment. This is particularly the case in medical applications where a particular energy may be called for by the treatment profile. Linear standing wave accelerators comprise a series of accelerating cavities which are coupled by way of coupling cavities which communicate with an adjacent pair of accelerating cavities. According to U.S. Pat. No. 4,382,208, the energy of the electron beam is varied by adjusting the extent of coupling between adjacent accelerating cavities. This is normally achieved by varying the geometrical shape of the coupling cavity.

This variation of the geometrical shape is typically by use of sliding elements which can be inserted into the coupling cavity in one or more positions, thereby changing the internal shape. There are a number of serious difficulties with this approach. Often more than one such element has to be moved in order to preserve the phase shift between cavities at a precisely defined value. The movement of the elements is not usually identical, so they have to be moved independently, yet be positioned to very great accuracy in order that the desired phase relationship is maintained. Accuracies of ±0.2 mm are usually required. This demands a complex and high-precision positioning system which is difficult to engineer in practice. In those schemes which have less than two moving parts (such as that proposed in U.S. Pat. No. 4,286,192), the device fails to maintain a constant phase between input and output, making such a device unable to vary RF fields continuously, and are thus reduced to the functionality of a simple switch. They are in fact often referred to as an energy switch.

Many of these schemes also propose sliding contacts which must carry large amplitude RF currents. Such contacts are prone to failure by weld induced seizure, and the sliding surfaces are detrimental to the quality of an ultra high vacuum system. Issues of this nature are key to making a device which can operate reliably over a long lifetime.

The nature of previous proposed solutions can be summarised as cavity coupling devices with one input and one output hole, the whole assembly acting electrically like a transformer. To achieve variable coupling values the shape of the cavity has had to be changed in some way, by means of devices such as bellows, chokes and plungers. However the prior art does not offer any device which can vary the magnitude of the coupling continuously over a wide range by means of a single axis control, whilst simultaneously maintaining the phase at a constant value.

The present state of the art is that such designs are accepted as providing a useful way of switching between two predetermined energies. However, it is very difficult to obtain a reliable variable energy accelerator using such designs. A good summary of the prior art can be found in U.S. Pat. No. 4,746,839.

Our earlier application No. PCT/GB99/00187 describes a novel form of linear accelerator in which there are a plurality of resonant cavities located along a particle beam axis, at least one pair of resonant cavities electromagnetically coupled via a coupling cavity, the coupling cavity being substantially rotationally symmetric about its axis, but including an element adapted to break that symmetry, the element being rotatable within the coupling cavity, that rotation being substantially parallel to the axis of symmetry of the coupling cavity.

In such an apparatus, a resonance can be set up in the coupling cavity which is of a transverse nature to that within the accelerating cavities. It is normal to employ a TM mode of resonance with the accelerating cavities, meaning that a TE mode, such as $TE_{111}$, can be set up in the coupling cavity. Because the cavity is substantially rotationally symmetric, the orientation of that field is not determined by the cavity. It is instead fixed by the rotational element. Communication between the coupling cavity and the two accelerating cavities can then be at two points within the surface of the coupling cavity, which will then "see" a different magnetic field depending on the orientation of the TE standing wave. Thus, the extent of coupling is varied by the simple expedient of rotating the rotational element.

This arrangement offers significant advantages over the previously described accelerators in that true variable energy output over a wider range is possible from a device which is more straightforward to manufacture and maintain. However, the resonant frequency of the coupling cell shows a small dependence on the angle of the rotateable element, as can be seen from FIG. 6. This resonant frequency is that at which the coupling cell resonates when resonances in the adjacent accelerating cells are suppressed, and is a factor affecting the degree of coupling achieved by the cell. FIG. 6 shows that as the element (according to PCT/GB99/00187) is rotated, the frequency varies sinusoidally by ±40 MHz. Expressed as a fraction of the mean frequency of this example, 2985 MHz, this is only a relatively small variation. However, it would be desirable to reduce or even completely remove it if possible.

One advantage of reducing or eliminating the variation of resonance frequency of this coupling cell as the element is rotated is that this would help to ensure that, at all angles of the rotatable element, an acceptable minimum separation of frequency is maintained between the resonance frequency of the desired operating $\pi/2$ mode of the coupled set of cavities and neighbouring resonance frequencies of unwanted modes of the coupled set.

SUMMARY OF INVENTION

The present invention therefore provides a standing wave linear accelerator, comprising a plurality of resonant cavities located along a particle beam axis, at least one pair of resonant cavities being electromagnetically coupled via a coupling cavity communicating with the resonant cavities via apertures, there being a rotationally asymmetric element within the coupling cavity adapted to rotate about a axis substantially parallel to the axis of the coupling cavity, the coupling cavity being imperfectly rotationally symmetric about its axis, the imperfection being at least due to a relative excess of material disposed within the cavity in the portion thereof opposed to the apertures.

Thus, whilst the coupling cavity is near rotationally symmetric in preferred embodiments, it departs from precise rotational symmetry by a relative excess of material which is believed to act as set out below. A relative excess of material can be provided by material. which projects inwardly into the cavity from a notional rotationally symmetric outline, or by a corresponding removal of material elsewhere.

In this respect, it is preferred that the relative excess of material comprises an inwardly directed projection on an internal wall of the cavity for ease of engineering. For maximum effect (and hence minimum extent of projection), the projection preferably extends along a length of the coupling cavity greater than the length of the apertures along the cavity axis.

Alternatively, the relative excess of material can comprise a projection extending into the cavity from an end wall thereof. For example, it can be defined by an end wall of the cavity being non-perpendicular with respect to a longitudinal axis of the coupling cavity.

In preferred embodiments of the standing wave linear accelerator, the apertures are non-identical in size. In that case, it is preferred that the relative excess of material is offset towards a location opposite the larger aperture.

It will be apparent that the present invention is a development of that shown in PCT/GB99/00187, corresponding to U.S. Pat. No. 6,376,990, an understanding of which is therefore useful in understanding the present invention. As a result, PCT/GB99/00187 (U.S. Pat. No. 6,376,990) is incorporated herein by reference and notice is given that the contents of this specification are intended to be read in conjunction with the contents of PCT/GB99/00187, and accordingly protection may be sought for the combination of features disclosed in this application and PCT/GB99/00187 (U.S. Pat. No. 6,376,990).

It is thought that this approach is effective in damping the frequency dependence of the device since as the rotatable element rotates, the E and B fields rotate accordingly. In such a coupling cavity, the E and B fields are aligned transverse to each other, and therefore the relative excess of material effectively moves from a location in a predominantly E field to a predominantly B field (or vice versa). When in a strong E field, conductive matter will tend to cause a frequency reduction. Likewise, when in a strong B field, conductive matter will tend to cause a frequency increase. Thus, as the fields rotate a variable correction is applied to the frequency. This variation is itself sinusoidally dependent on the angle of the rotatable member, but arranged to be in antiphase to the frequency dependence. Therefore the net effect can be reduced or even eliminated.

This implies that the magnitude of the relative excess of material and its location with respect to the field pattern will control the amount by which the frequency response is damped. As a result, the appropriate size of the relative excess will be dictated by its location within the E and B fields. If located in a position mid-way between the end walls of the cavity where the electric field intensity (E) and the magnetic field intensity (B) become alternately very strong as the rotateable element is rotated, the projection will have a greater effect and need not be as large as if located near the ends or edges of the cavity. It will generally be possible to arrive at suitable dimensions and locations by trial and error.

BRIEF DESCRIPTION OF DRAWINGS

An embodiment of the present invention will now be described by way of example, with reference to the accompanying drawings, in which.

DETAILED DESCRIPTION OF THE EMBODIMENTS

FIGS. 1–5 illustrate the accelerator described in PCT/GB99/00187, corresponding to U.S. Pat. No. 6,376,990. They are not encompassed by the present invention but are presented herein to assist in a full understanding of the present invention and its context. These figures illustrate a short sub-element of a linear accelerator, consisting of two accelerating cavities and the halves of two coupling cavities either side. In addition, the element includes a single coupling cavity embodying the present invention, joining the two accelerating cavities. A complete accelerator would be made up of several such sub-elements joined axially.

Figure 1:
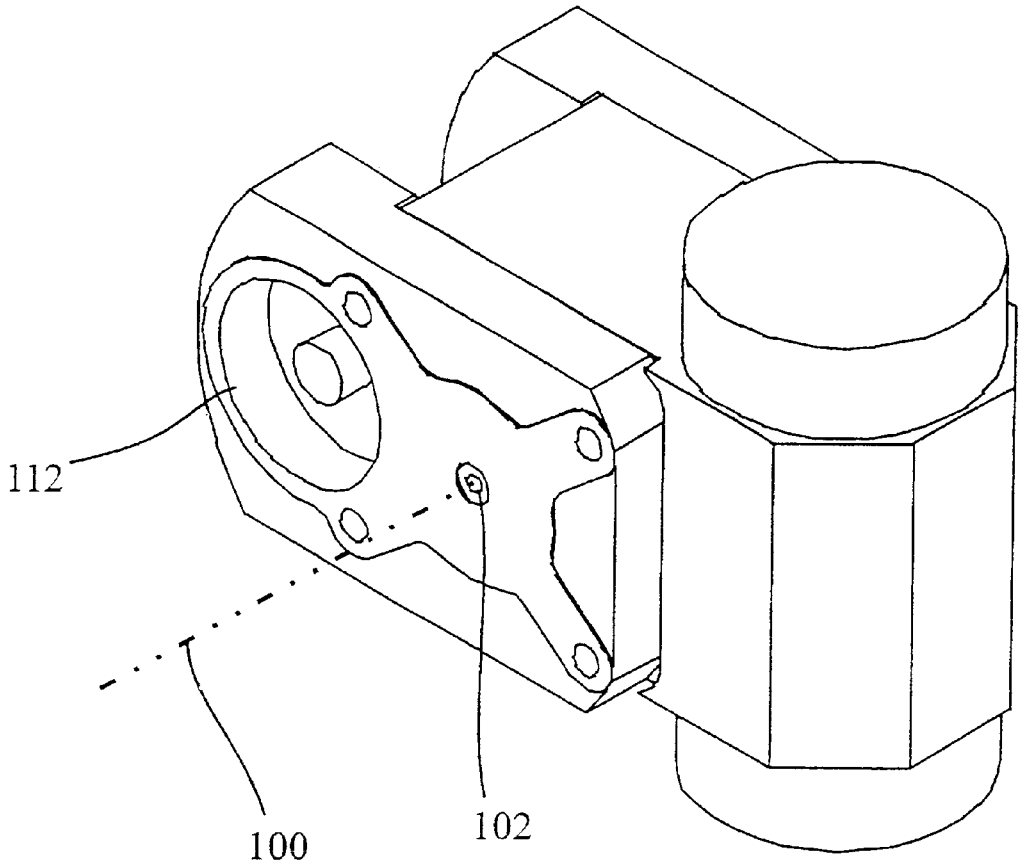
FIG. 1 is a perspective view of an accelerator element as shown in PCT/GB99/00187 (U.S. Pat. No. 6,376,990)

In FIG. 1, the axis 100 of the accelerating cavities passes into a small opening 102 into a first accelerating cavity 104 (not visible in FIG. 1). A further accelerating cavity 108 communicates with the first accelerating cavity 104 via an aperture 106. The second cavity 108 then has a further aperture 110 on its opposing side to communicate with subsequent accelerating cavities formed when the sub-element of this embodiment is repeated along the axis 100. Thus, a beam being accelerated passes in order through apertures 102, 106, 110 etc.

A pair of coupling half-cavities are formed in the illustrated sub-element. The first half cavity 112 provides a fixed magnitude coupling between the first accelerating cavity 104 and an adjacent accelerating cavity formed by an adjacent sub-element. This adjacent sub-element will provide the remaining half of the coupling cavity 112. Likewise, the second coupling cavity 114 couples the second accelerating 108 to an adjacent cavity provided by an adjacent element. Each coupling cavity includes an upstanding post 116, 118 which tunes that cavity to provide the appropriate level of coupling desired. The coupling cavities 112, 114 are conventional in their construction.

The first accelerating cavity 104 is coupled to the second accelerating cavity 108 via an adjustable coupling cavity 120. This consists of a cylindrical space within the element, the axis of the cylinder being transverse to the accelerator axis 100 and spaced therefrom. The spacing between the two axes at their closest point and the radius of the cylinder is adjusted so that the cylinder intersects the accelerating cavities 104, 108, resulting in apertures 122, 124. As illustrated in this embodiment, the cylinder 120 is positioned slightly closer to the second accelerating cavity 108, making the aperture 124 larger than the aperture 122. Depending on the design of the remainder of the accelerator, this asymmetry may in certain circumstances be beneficial. However, it is not essential and in other designs may be more or less desirable.

At one end of the adjustable coupling cavity 120, an aperture 126 is formed to allow a shaft 128 to pass into the interior of the cavity. The shaft 128 is rotatably sealed in the aperture 126 according to known methods. Within the adjustable cavity 120, the shaft 128 supports a paddle 130 which is therefore rotationally positionable so as to define the orientation of a $TE_{111}$ field within the adjustable coupling cavity 120 and thus dictate the amount of coupling between the first cavity 104 and the second cavity 108.

Cooling channels are formed within the element to allow water to be conducted through the entire construction. In this example, a total of four cooling channels are provided, equally spaced about the accelerating cavities. Two cooling channels 132, 134 run above and below the fixed coupling cavities 112, 114 and pass straight through the unit. Two further coupling cavities 136, 138 run along the same side as the variable cavity 120. To prevent the cooling channels conflicting with the accelerating cavities 104, 108 or the adjustable coupling cavity 120, a pair of dog legs 140 are formed, as most clearly seen in FIGS. 2 and 3.

Figure 3:
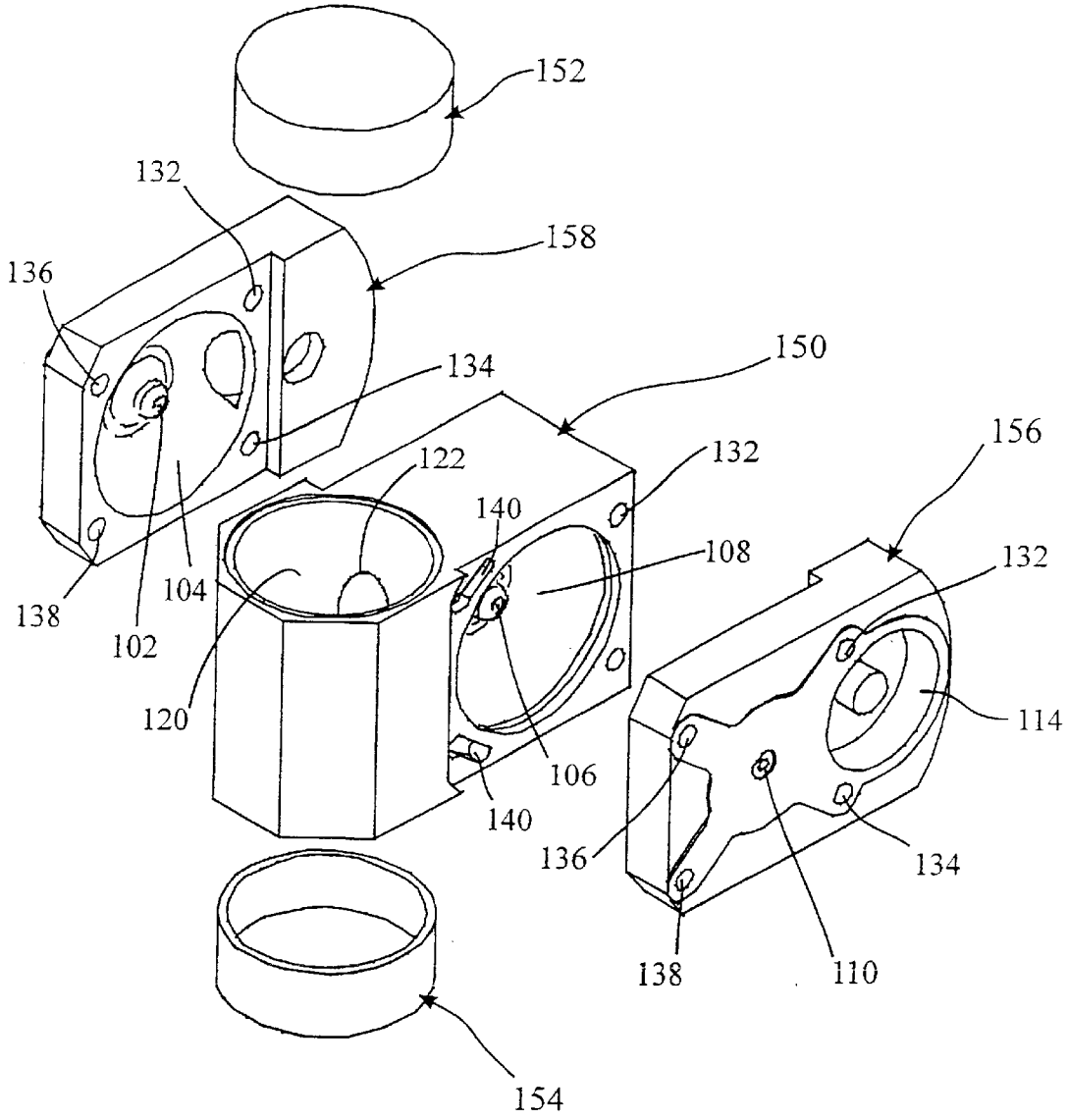
FIG. 3 is an exploded view of the embodiment of FIG. 1.
Figure 4:
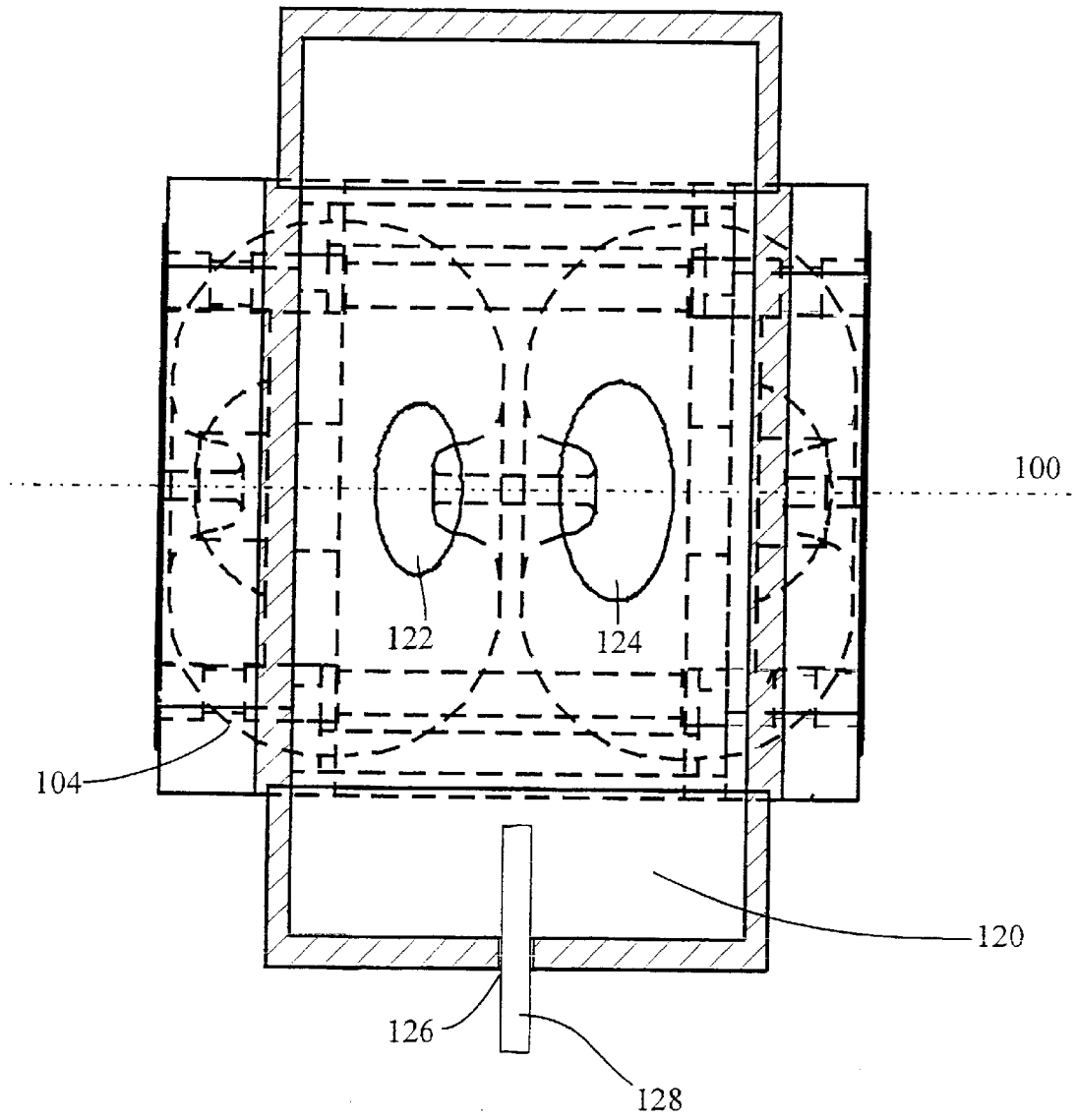
FIG. 4 is a section on IV—IV of FIG. 2.

FIG. 3 shows an exploded view of the example illustrating the manner in which it can constructed. A central base unit 150 contains the coupling cavity and two halves of the first and second accelerating cavities 104, 108. The two accelerating cavities can be formed by a suitable turning operation on a copper substrate, following which the central communication aperture 106 between the two cavities can be drilled out, along with the coolant channels 132, 134, 136, 138 and the dog leg 140 of the channels 136 and 138. The adjustable coupling cavity 120 can then be drilled out, thereby forming the apertures 122 and 124 between that cavity and the two accelerating cavities 104, 108. Caps 152, 154 can then be brazed onto top and bottom ends of the adjustable coupling cavity 120, sealing it.

End pieces 156, 158 can then be formed for attachment either side of the central unit 150 by a brazing step. Again, the remaining halves of the coupling cavities 104, 108 can be turned within these units, as can the half cavities 112, 114. Coolant channels 132, 134, 136 and 138 can be drilled, as can the axial communication apertures 102, 110. The end pieces can then be brazed in place either side of the central unit, sealing the accelerating cavities and forming a single unit.

A plurality of like units can then be brazed end to end to form an accelerating chain of cavities. Adjacent pairs of accelerating cavities will be coupled via fixed coupling cavities, and each member of such pairs will be coupled to a member of the adjacent pair via an adjustable coupling cavity 120.

The brazing of such units is well known and simply involves clamping each part together with a foil of suitable eutectic brazing alloy therebetween, and heating the assembly to a suitable elevated temperature. After cooling, the adjacent cavities are firmly joined.

The paddle serves to break the symmetry of the cavity 120, thus forcing the electric lines of field to lie perpendicular to the paddle surface. The end result is a device which has just one simple moving part, which upon rotation will provide a direct control of the coupling between cells, whilst at the same time keeping the relative phase shift between input and output fixed, say at a nominal $\pi$ radians. The only degree of freedom in the system is the angle of rotation of the paddle. In a typical standing wave accelerator application this would only have to be positioned to the accuracy of a few degrees, the accuracy depending on the energy selected. Such a control would allow the energy of a linear accelerator to be adjusted continuously over a wide range of energy.

Figure 6:
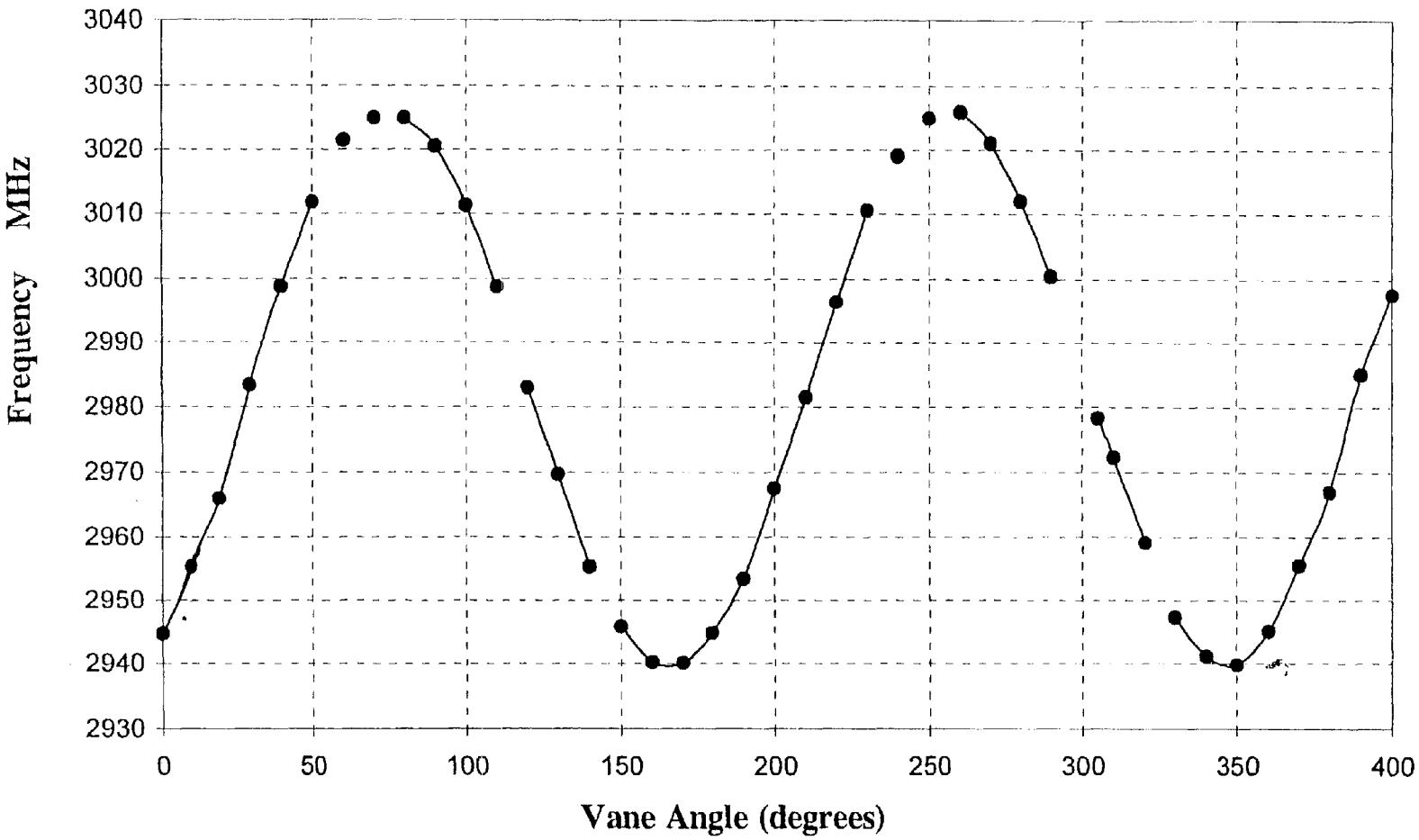
FIG. 6 is a graph showing the dependence of resonant frequency of the coupling cell on paddle angle of the device shown in FIGS. 1 to 5.

FIG. 6 shows a sample resonant frequency of the coupling cell 120 for this device. It can be seen that whilst this frequency is very stable, the apparently large perturbations being visible due to the scale chosen, there is a distinct sinusoidal variation in frequency as the paddle is rotated. This is dealt with by the embodiments of the invention which follow.

Figure 5:
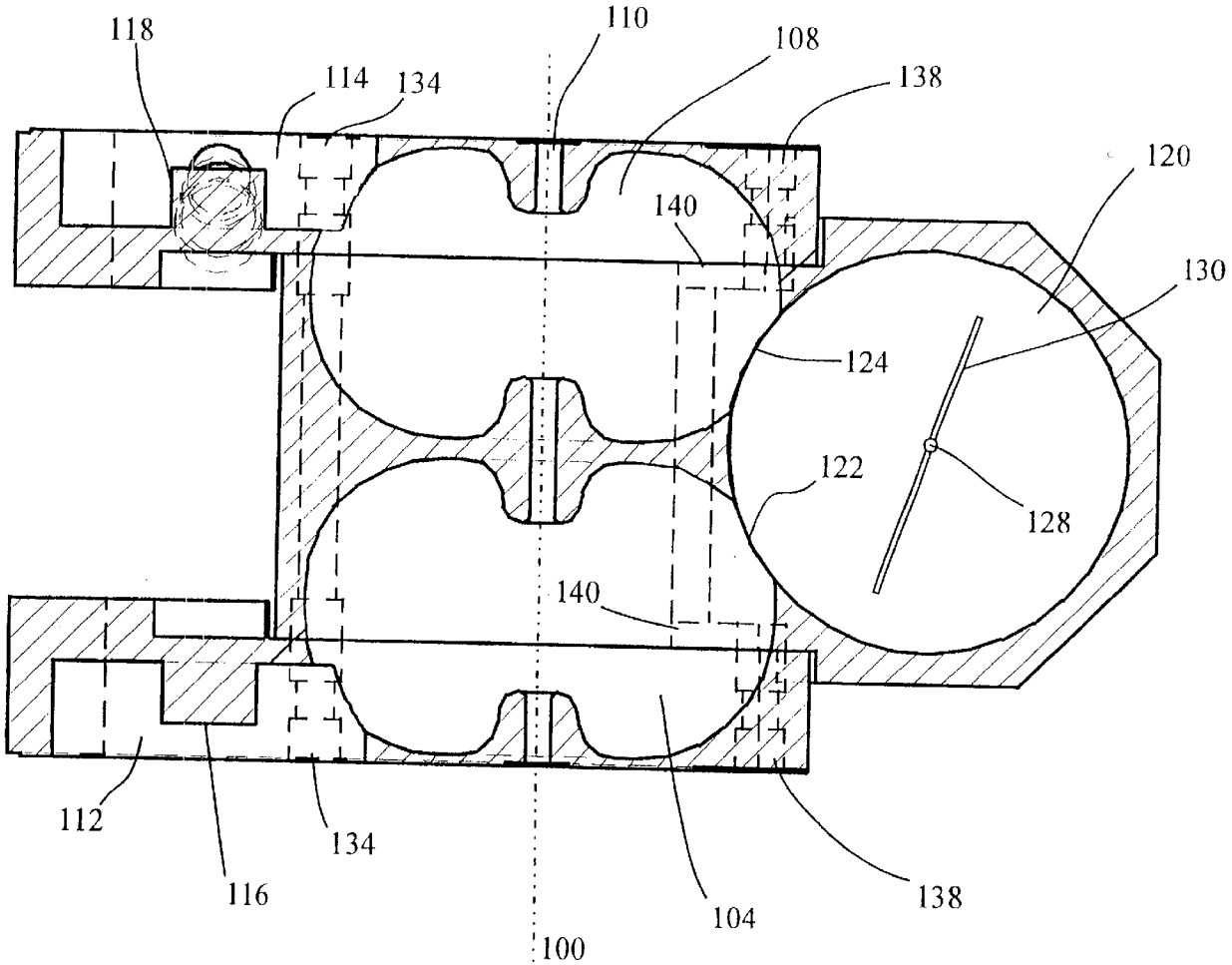
FIG. 5 is a section on V—V of FIG. 2.
Figure 7:
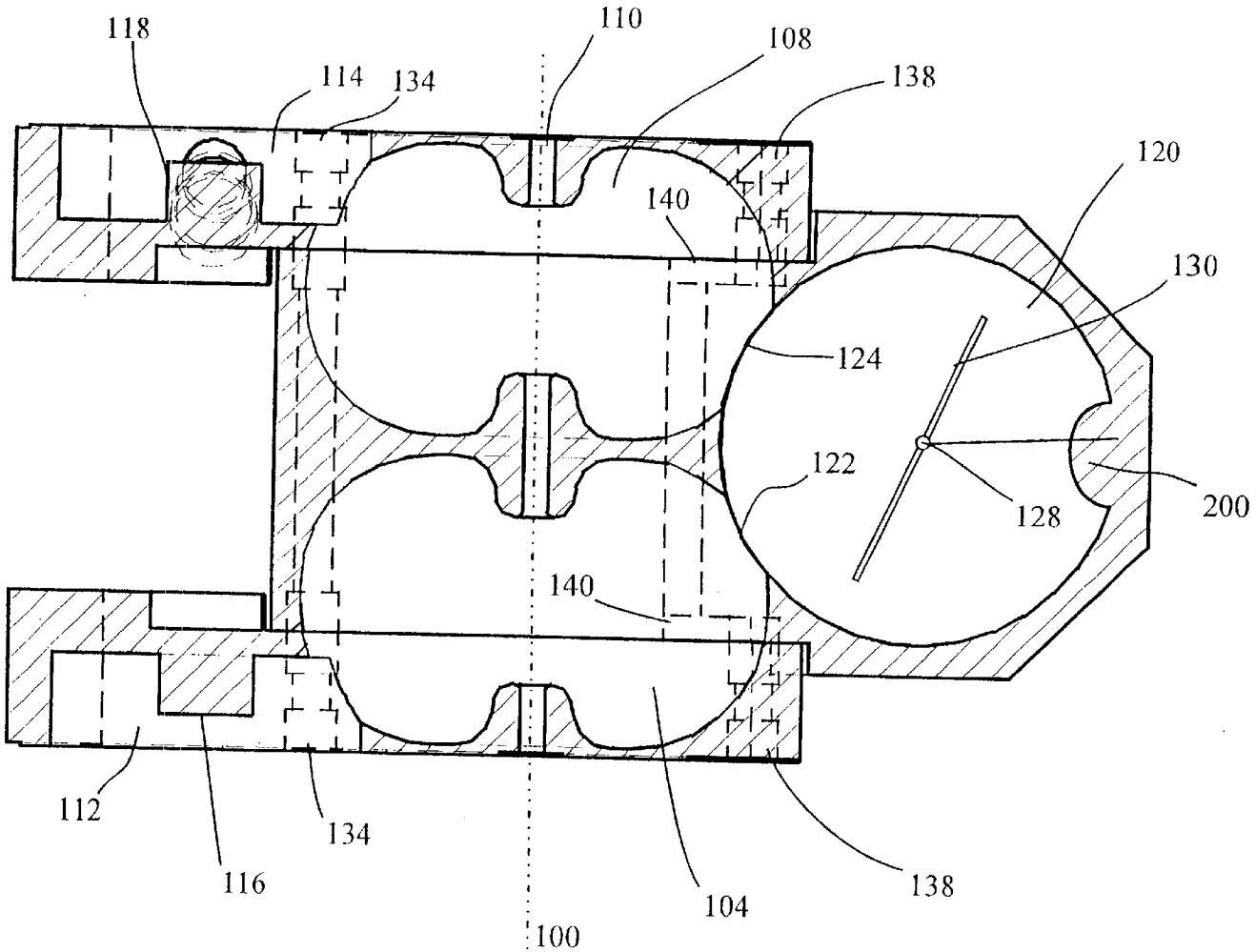
FIG. 7 is a view corresponding to that of FIG. 5 showing a first embodiment of the invention.

FIG. 7 shows a cross-section corresponding generally to that of FIG. 5, and therefore like reference numerals have been employed to denote like parts. This embodiment of the invention differs by the provision of an inwardly directed ridge 200 which is provided along a portion of the length of the coupling cavity 120. In the embodiment, the ridge has a smooth half-elliptic section, but this is not essential to the invention and other shapes will be easier to machine and may offer advantageous resonant properties. It is located generally opposite the mid-point of the coupling apertures 122, 124, but displaced slightly toward the position opposite the larger aperture 124. The precise position is about that of the mean position opposite the apertures weighted according to their size.

The ridge 200 is believed to operate as set out above, i.e. by damping the frequency dependence of the device as the rotatable element 130 rotates, tending to cause a frequency reduction when in a strong E field and tending to cause a frequency increase when in a strong B field. Thus, as the fields rotate with the rotatable element 130 a sinusoidally variable correction is applied to the frequency in antiphase to the existing frequency dependence. Therefore the net effect can be reduced or even eliminated.

Figure 8:
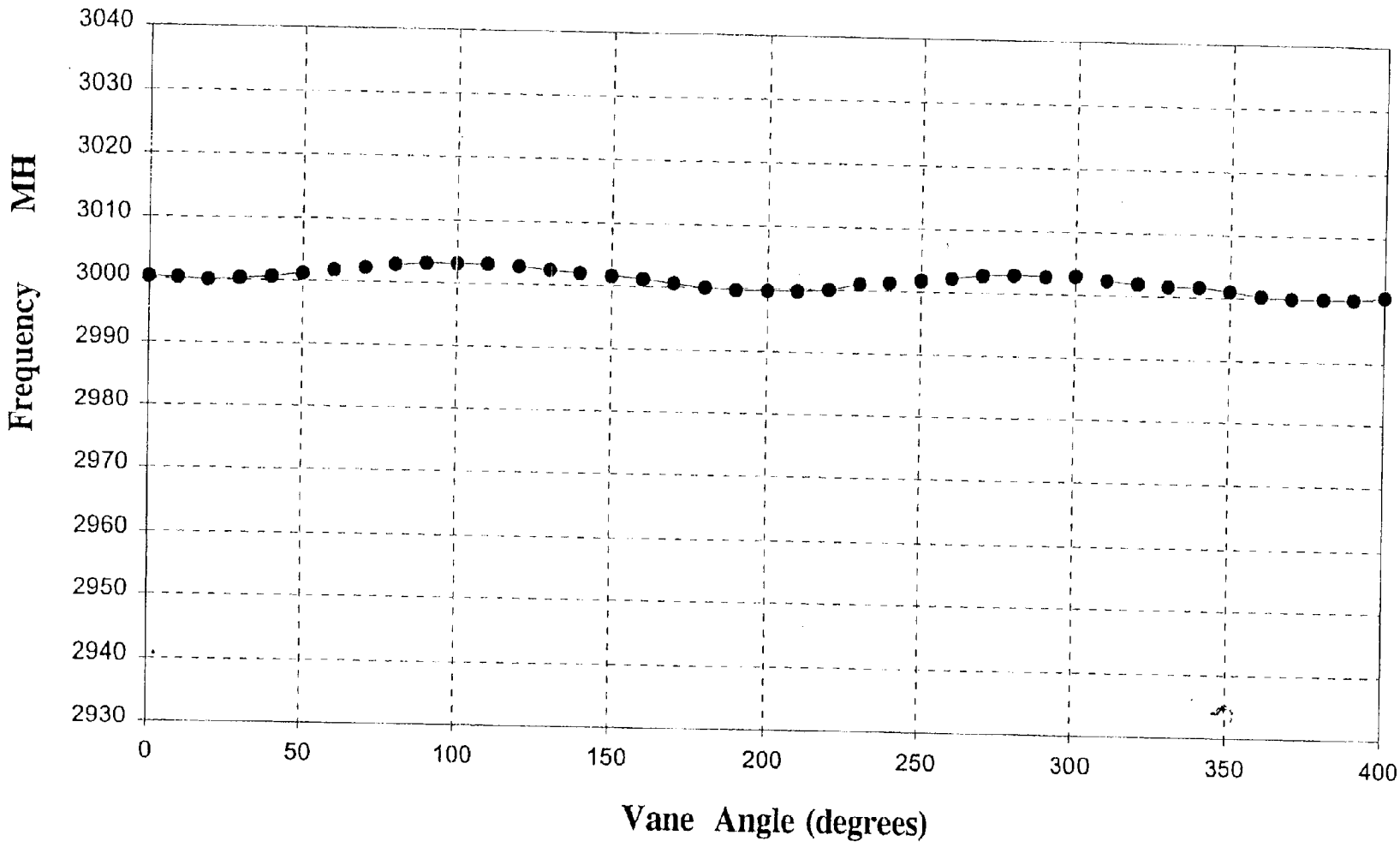
FIG. 8 is a graph showing the dependence of resonant frequency of the coupling cell on paddle angle of the device shown in FIG. 7.

FIG. 8 shows the result, using identical scales to those of FIG. 6. It can be seen that the frequency dependence of the coupling cell 120 is significantly reduced, to a range of about ±5 MHz in 3000 MHz, ie below 0.2%. As a result, the energy of the output beam can be varied over a significant range with effectively no variation of this frequency.

The size of the projection is a matter of trial and error. It is expected that the effect of the projection upon the frequency response will be in proportion to its size. Hence, a small projection will not fully eliminate the frequency response, and an over-large projection will overcompensate and result in a frequency response in antiphase. Given that the magnitude of the frequency response is a result of the geometry of the remainder of the device, the size of the projection is a dependent on the precise details of the resonant system in which it is to be provided.

Figure 9:
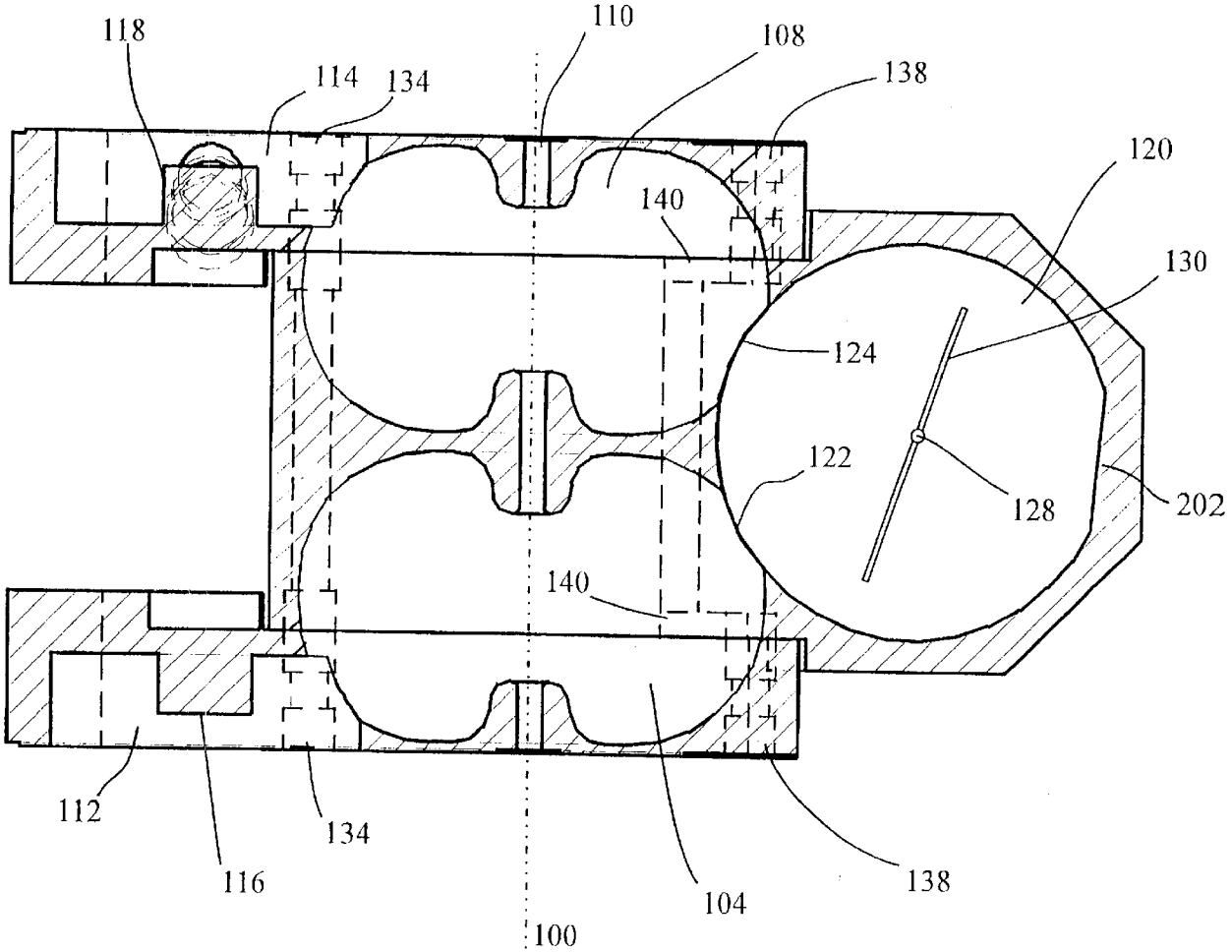
FIG. 9 is a view corresponding to that of FIG. 5 showing a second embodiment of the invention.

FIG. 9 shows a second embodiment of the invention. In this embodiment, the relative excess of material is provided by a projection 202 which consists of a flattened area on the curved face of the otherwise cylindrical coupling cavity 120.

Figure 10:
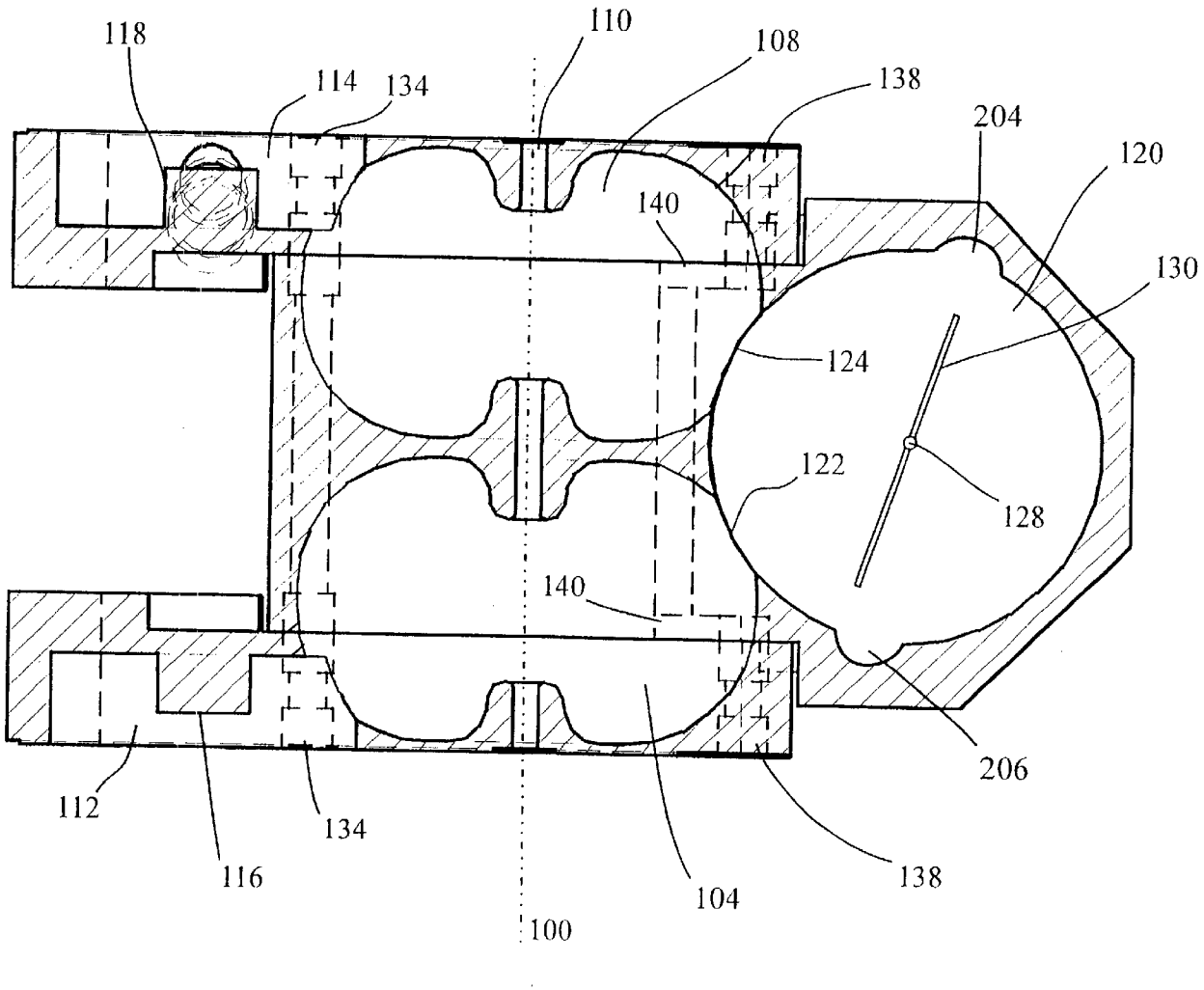
FIG. 10 is a view corresponding to that of FIG. 5 showing a third embodiment of the invention.

FIG. 10 shows a third embodiment. In this case, a relative excess of material is provided by removing material at the two points 204, 206 transverse to that at which material is added in the first two embodiments above. This has essentially the same effect. It may be easier to engineer since the coupling cavity can be bored out before or after boring out the pair of compensating recesses 204, 206.

Figure 2:
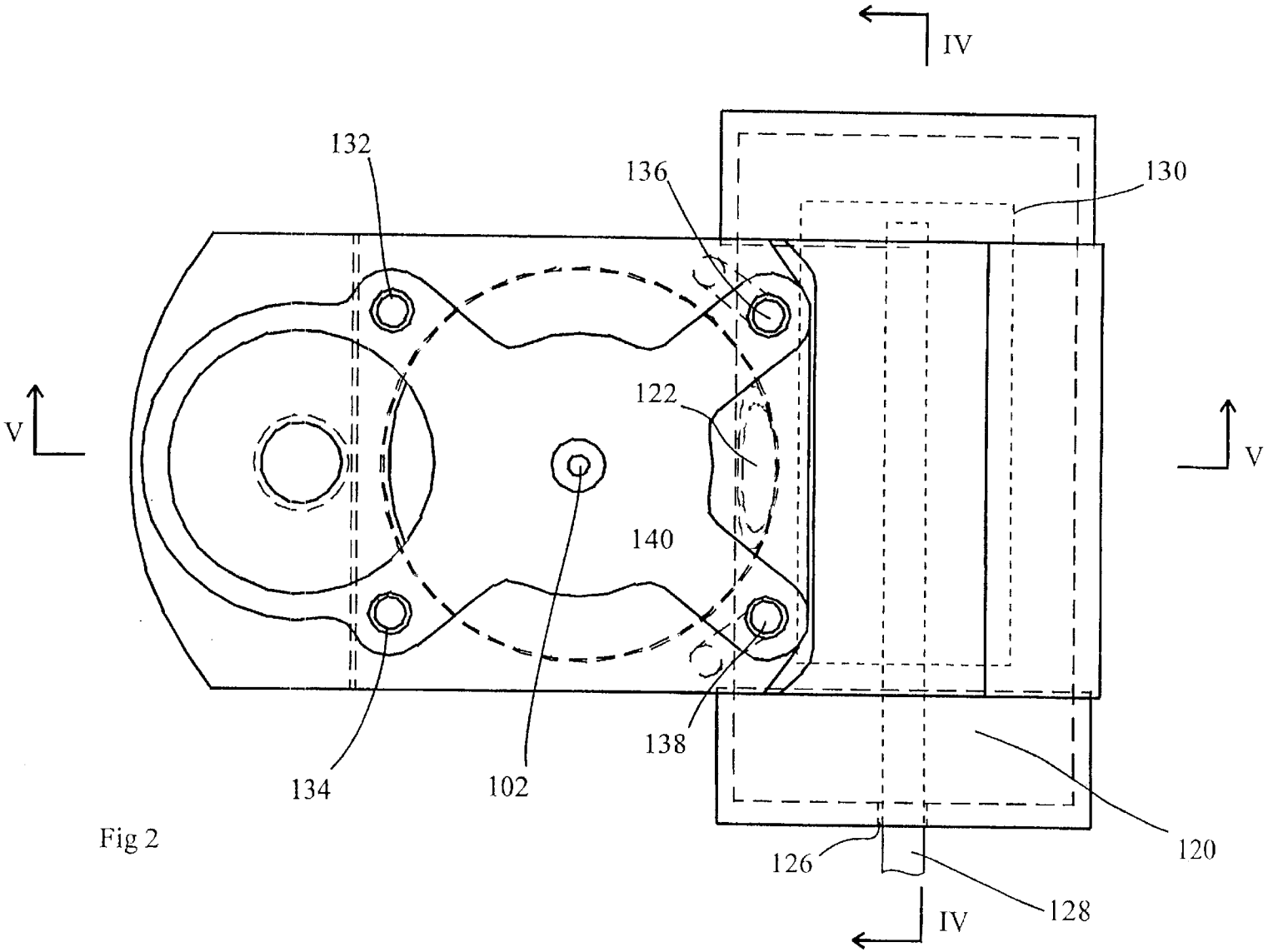
FIG. 2 is an axial view of the embodiment of FIG. 1.
Figure 11:
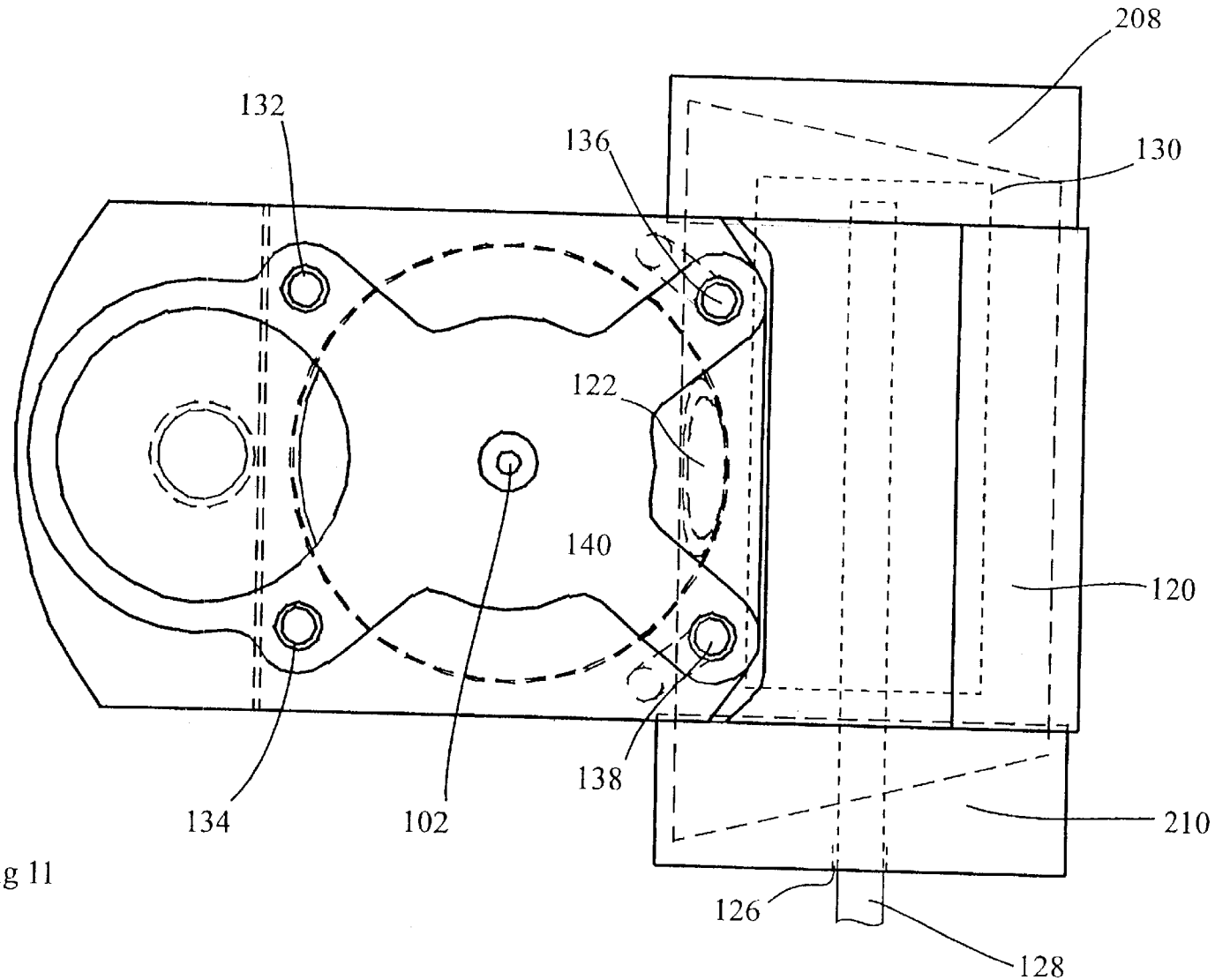
FIG. 11 is a view corresponding to that of FIG. 2 showing a fourth embodiment of the invention.

FIG. 11 shows a cross-section corresponding to that of FIG. 2. Again, like reference numerals have been used to denote like parts. In the fourth embodiment illustrated in FIG. 11, a relative excess of material has been provided by angling in the flat end faces of the cylindrical section coupling cavity 120. Thus, the axial length of the cavity is less at the position opposite the weighted mean position of the apertures 122, 124.

As the peak intensity of the E field within the coupling cavity is at the centre, it is expected that this arrangement will be less effective than embodiments 1 to 3. However, this could be compensated for be adjusting the size of the additional volumes of material 208, 210 thus created. As this arrangement may be more straightforward to manufacture, it may nevertheless be preferred.

Figure 12:
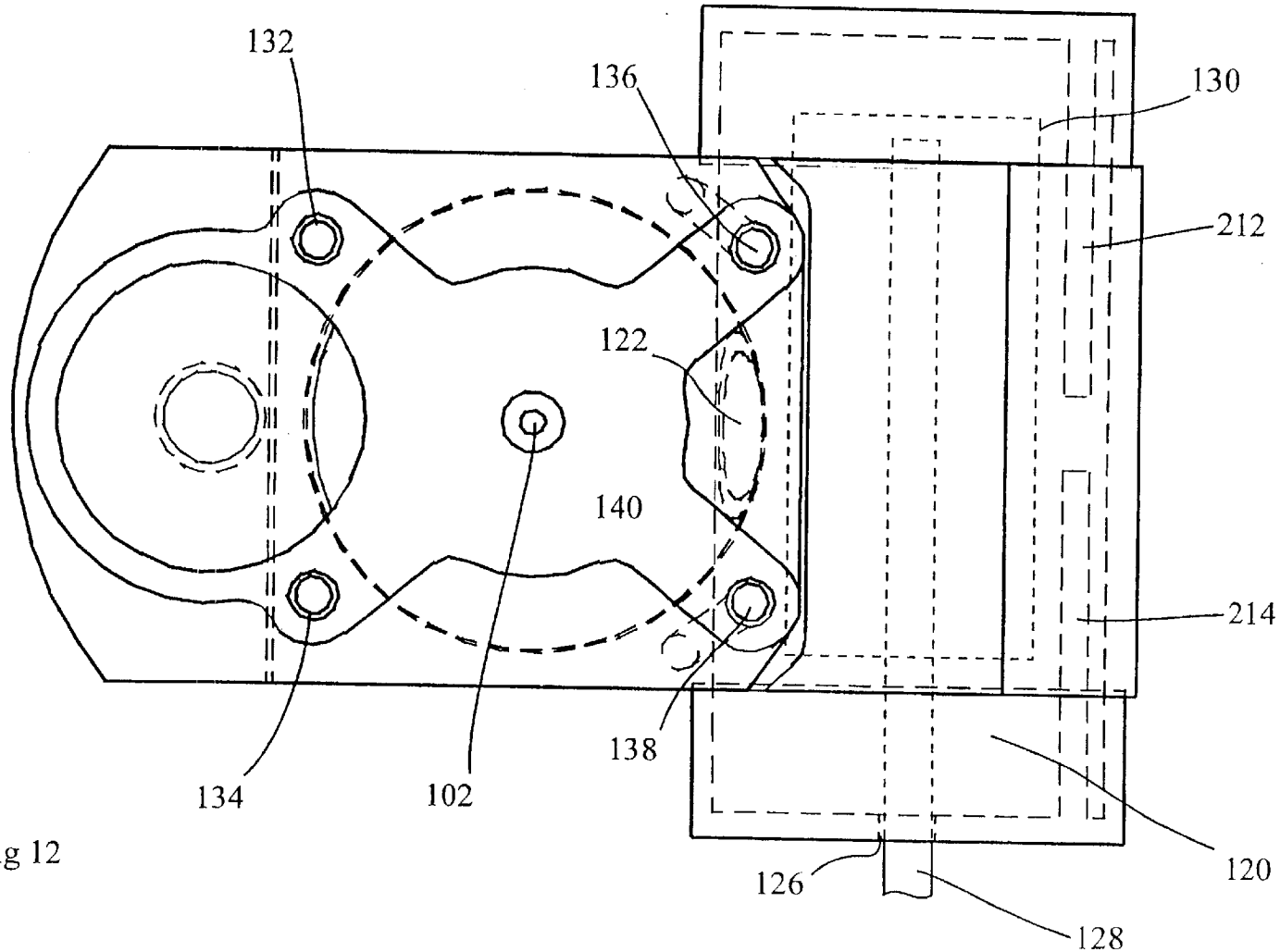
FIG. 12 is a view corresponding to that of FIG. 2 showing a fifth embodiment of the invention.

FIG. 12 shows a fifth embodiment. The end caps of the coupling cavity 120 each carry an inwardly directed projection 212, 214 in the form of a rod. These extend into the centre of the cavity 120 and are arranged to lie in corresponding positions to the projections 200 of the first embodiment, but (as shown) are slightly separated from the side wall of the cavity. The rods need not be provided on both end faces, but this offers a more symmetric arrangement.

It will of course be appreciated by those skilled in the art that the above-described embodiment is simply illustrative of the present invention, and that many variations could be made thereto.

What is claimed is:

1. A standing wave linear accelerator, comprising a plurality of resonant cavities located along a particle beam axis, at least one pair of resonant cavities being electromagnetically coupled via a coupling cavity communicating with the resonant cavities via apertures, there being a rotationally asymmetric element within the coupling cavity adapted to rotate about a axis substantially parallel to the axis of the coupling cavity, the coupling cavity being imperfectly rotationally symmetric about its axis, the imperfection being at least due to a relative excess of material disposed within the cavity in the portion thereof opposed to the apertures.

2. The standing wave linear accelerator according to claim 1 in which the relative excess of material comprises an inwardly directed projection on an internal wall of the cavity.

3. The standing wave linear accelerator according to claim 2 in which the projection extends along a length of the coupling cavity greater than the length of the apertures along the cavity axis.

4. The standing wave linear accelerator according to claim 1 in which the relative excess of material comprises a projection extending into the cavity from an end wall thereof.

5. The standing wave linear accelerator according to claim 4 in which the projection is defined by an end wall of the cavity being non-perpendicular with respect to a longitudinal axis of the coupling cavity.

6. The standing wave linear accelerator according to claim 1, where the apertures are non-identical in size and the relative excess of material is offset towards a location opposite the larger aperture.

7. The standing wave linear accelerator according to claim 1 in which the relative excess of material is provided by at least one recess formed in at least one wall of the cavity located laterally with respect to the apertures.

8. The standing wave linear accelerator according to claim 7 where the apertures are non-identical in size and the at least one recess is offset towards a location lateral with respect to the larger aperture.

9. A standing wave linear accelerator comprising:

a first accelerating cavity and a second accelerating cavity located along a particle beam axis;

a coupling cavity electromagnetically coupled to the first accelerating cavity via a first aperture and to the second accelerating cavity via a second aperture, the coupling cavity being non-cylindrical; and a rotationally asymmetric element disposed within the coupling cavity and adapted to rotate about an axis substantially normal to the particle beam axis.

10. The standing wave linear accelerator of claim 9 wherein the coupling cavity is non-cylindrical due to a relative excess of material within the coupling cavity disposed along a portion of a length of the coupling cavity opposite to the first and the second apertures.

11. The standing wave linear accelerator of claim 10 wherein the relative excess of material is an inwardly directed ridge.

12. The standing wave linear accelerator of claim 9 wherein the coupling cavity is non-cylindrical due to a relative excess of material disposed within the coupling cavity at a position opposite a midpoint between the first aperture and the second aperture.

13. The standing wave linear accelerator of claim 9 wherein the first aperture and the second aperture have different sizes, and wherein the coupling cavity is non-cylindrical due to a relative excess of material disposed within the coupling cavity at a position opposite a weighted midpoint between the first aperture and the second aperture.

14. The standing wave linear accelerator according to claim 9, wherein the first and the second apertures have different sizes, and wherein the relative excess of material is offset towards a location opposite the larger aperture.

15. A standing wave linear accelerator having a plurality of resonant cavities located along a particle beam axis, comprising:

a coupling cavity for electromagnetically coupling a first and a second resonant cavities via first and second apertures, the coupling cavity being imperfectly rotationally symmetric about a cavity axis of the coupling cavity due to a relative excess of material disposed within the coupling cavity; and a rotationally asymmetric element within the coupling cavity adapted to rotate about an axis substantially parallel to the cavity axis.

16. The standing wave linear accelerator according to claim 15 in which the relative excess of material extends along a length of the coupling cavity greater than a length of the first and the second apertures along the cavity axis.

17. The standing wave linear accelerator according to claim 16 wherein the apertures are non-identical in size, and the relative excess of material is offset towards a larger one of the apertures.

18. The standing wave linear accelerator according to claim 15 in which the relative excess of material extends into the coupling cavity from an end wall of the coupling cavity.

19. The standing wave linear accelerator according to claim 18 wherein the relative excess of material is defined by an end wall of the coupling cavity being at an angle other than perpendicular with respect to the cavity axis.

20. The standing wave linear accelerator according to claim 15 wherein a frequency dependence of the coupling cavity is below 0.2%.

21. The standing wave linear accelerator according to claim 15 wherein the relative excess of material is a ridge and wherein the ridge causes a frequency reduction when in a strong Electric field and a frequency increase when in a strong magnetic field.

22. The standing wave linear accelerator according to claim 21 rotation of the rotationally asymmetric element within the coupling cavity adjusts the relative strength of the Electrical field and the magnetic field.

* * * * *

UNITED STATES PATENT AND TRADEMARK OFFICE

CERTIFICATE OF CORRECTION

PATENT NO. : 6,642,678 B1
DATED : November 4, 2003
INVENTOR(S) : John Allen et al.

It is certified that error appears in the above-identified patent and that said Letters Patent is hereby corrected as shown below:

Column 2,
Line 67, delete “material.” and insert -- material --

Column 7,
Line 33, delete “a axis” and insert -- an axis --

Signed and Sealed this

Twenty-fifth Day of May, 2004

JON W. DUDAS
*Acting Director of the United States Patent and Trademark Office*